US010674252B2

(12) United States Patent
Proni et al.

(10) Patent No.: US 10,674,252 B2
(45) **Date of Patent: *Jun. 2, 2020**

(54) SELF-DRAINING LOUDSPEAKER SYSTEM

(71) Applicants: Lucio Proni, Weston, FL (US); Bellal J Hamze, Margate, FL (US)

(72) Inventors: Lucio Proni, Weston, FL (US); Bellal J Hamze, Margate, FL (US)

(73) Assignee: JL Audio, Inc, Miramar, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/517,960

(22) Filed: Jul. 22, 2019

(65) Prior Publication Data

US 2019/0349671 A1 Nov. 14, 2019

Related U.S. Application Data

(63) Continuation-in-part of application No. 15/484,312, filed on Apr. 11, 2017, now Pat. No. 10,362,389.

(51) Int. Cl.
*H04R 1/28* (2006.01)
*H04R 1/02* (2006.01)

(52) U.S. Cl.
CPC ..... *H04R 1/2849* (2013.01); *H04R 1/028* (2013.01); *H04R 2499/13* (2013.01)

(58) Field of Classification Search
CPC .... H04R 1/2849; H04R 1/025; H04R 1/2888; H04R 1/028; H04R 2499/13; H04R 1/26; H04R 1/44; B60R 11/0217; G10K 2210/127; G10K 2210/128
USPC ..... 381/86, 338, 335, 345, 337, 352, 386, 381/389, 302; 181/150, 152, 149
See application file for complete search history.

(56) References Cited

U.S. PATENT DOCUMENTS 3,642,091 A * 2/1972 Nohara ..... H04R 1/028 181/150
2009/0168024 A1* 7/2009 Hayashi ..... G03B 31/00 353/15

* cited by examiner

*Primary Examiner* — Norman Yu
(74) *Attorney, Agent, or Firm* — GrayRobinson, P.A.; Donald S. Showalter

(57) ABSTRACT

A loudspeaker system comprises a driver mounted within the interior of a single-reflex band-pass box or a ported box which employ one or more drain tubes to remove standing water that may pool therein without affecting the acoustic performance of the system.

6 Claims, 16 Drawing Sheets

SELF-DRAINING LOUDSPEAKER SYSTEM

FIELD OF THE INVENTION

This invention relates to loudspeaker systems, and, more particularly, to a loudspeaker system for use in environments where exposure to water is likely in which a speaker enclosure is provided that is self-draining to protect the driver from contact with standing water.

BACKGROUND OF THE INVENTION

Loudspeaker systems are frequently utilized in applications such as watercraft and outdoor settings where exposure to water and other elements can damage the system's driver(s). In sound systems for boats, the drivers are typically mounted in side bulkheads near the entertainment areas of the vessel to protect them from water damage and to direct acoustic output toward passengers seated in such areas. Smaller boats such as ski boats, bow riders, wakeboard boats and deck boats do not have a cabin or enclosed helm, and therefore essentially the entire deck area is open to the air. This allows acoustic energy from the drivers to dissipate quickly as it radiates into space, and it is particularly difficult for such systems to provide quality sound behind the boat such as to a skier being towed.

Loudspeaker systems are also commonly employed in porches, lanais, decks and other outdoor locations in and around homes and businesses. The enclosures which house drivers in these systems may be exposed to water from rain, blowing rain, spray from a water hose, pool splash and other sources. In this and watercraft applications, water entering and pooling within the interior of the enclosure can potentially damage the driver(s) and eventually degrade the structural integrity of the enclosure.

SUMMARY OF THE INVENTION

This invention is directed to a loudspeaker system including a driver mounted within the interior of an enclosure which is self-draining to protect the driver from exposure to standing water.

In several preferred embodiments, the enclosure is a band-pass box which is formed in two sections connected to one another to form a box interior. A driver is mounted to a plate within the box interior so that one side of the driver is located within a sealed volume of the band-pass box and its opposite side resides in a ported volume thereof. Acoustic output from the driver entering the ported volume is transmitted through a port to the outside of the box.

Several features of embodiments of this invention employing a band-pass box are designed to reduce exposure of the driver to water entering the box interior through the port. The plate which mounts the driver positions it above where water that enters the box interior may pool. A number of drain tubes are mounted over holes formed in the bottom of the band-pass box through which water may drain to further prevent pooling in the box interior. In some embodiments, the bottom wall of the band-pass box may be oriented at an angle so as to direct water that enters the box interior toward the drain tubes and/or the port.

The band-pass box of these embodiments may be utilized in watercraft to direct acoustic output from the driver toward the rear of the vessel or within its entertainment area. In watercraft that include an engine compartment, such as inboard and inboard-outboard boats, the band-pass box of this invention may be mounted to a panel which covers such compartment and is movable between open and closed positions. The drain tubes connected to the box interior are located within the engine compartment and preferably extend to the bilge where water from the box interior is directed.

In alternative embodiments, the loudspeaker system of this invention includes a ported box having a box interior that defines a ported volume. A driver and a port are mounted to the front wall within the box interior in position such that acoustic output from a front portion of the driver is directed toward a front wall of the ported box and the acoustic output from a rear portion of the driver is directed through the port and toward the front wall. One or more drain tubes connected to a bottom wall of the ported box are effected to drain water which may enter the box interior through the port. The loudspeaker system of these embodiments may be used in porches, lanais, decks and other outdoor locations in and around homes and businesses where exposure to water may occur.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE PREFERRED EMBODIMENT

Figure 14:
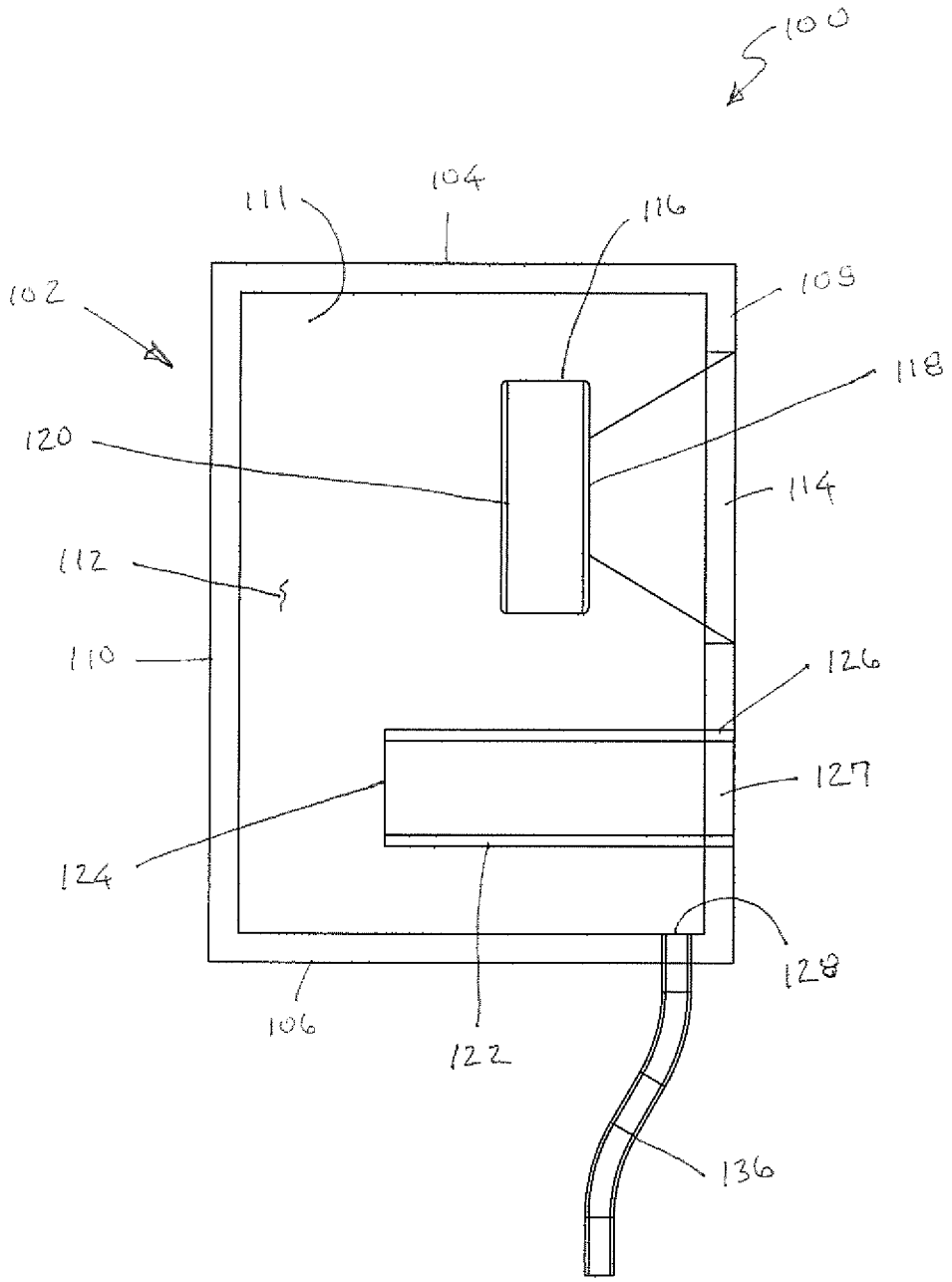
FIG. 14 is a side elevational view of an alternative embodiment of a loudspeaker system according to this invention depicting a ported box having one end wall removed for clarity which illustrates a box interior within which a driver and port are located and at least one drain tube connected to a bottom wall of the ported box.
Figure 15:
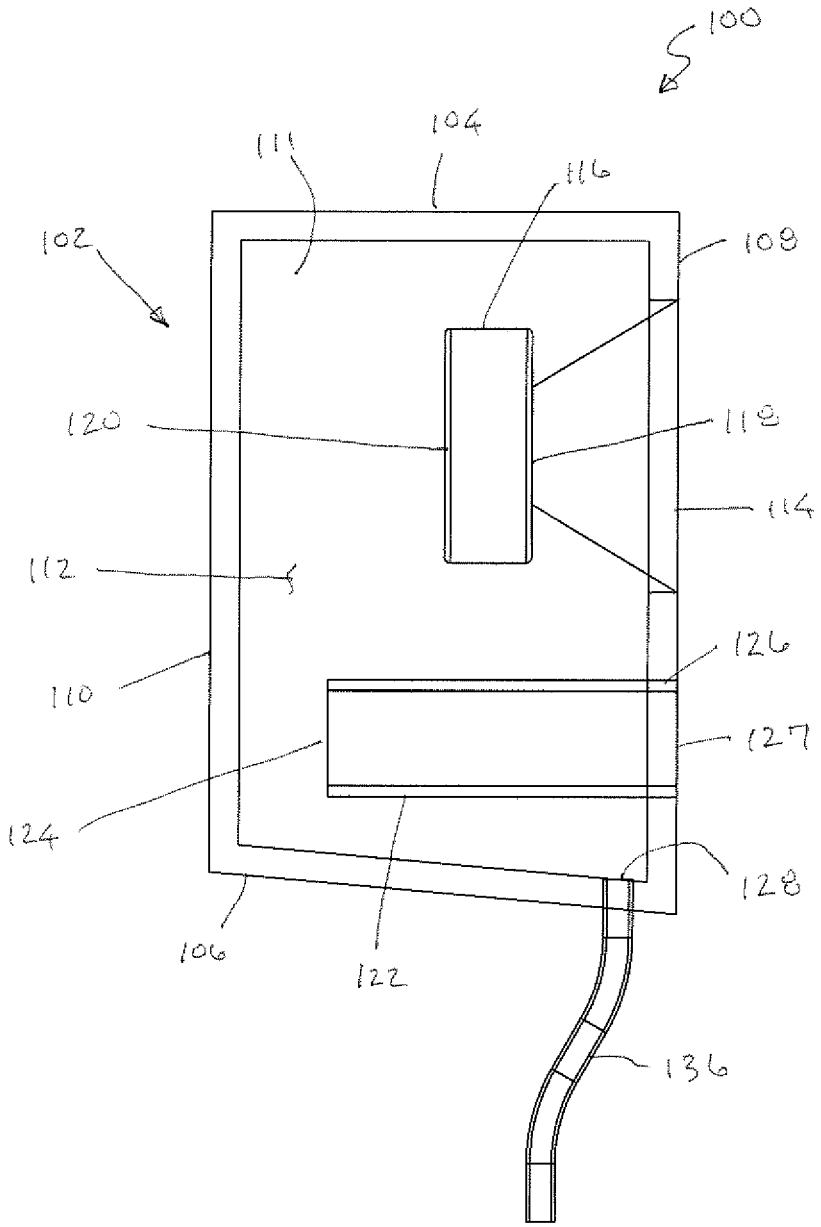
FIG. 15 is a view similar to FIG. 14 except wherein the bottom wall of the ported box is oriented at an angle relative to a top wall thereof to promote drainage of water that may enter the box interior through the port.
Figure 16:
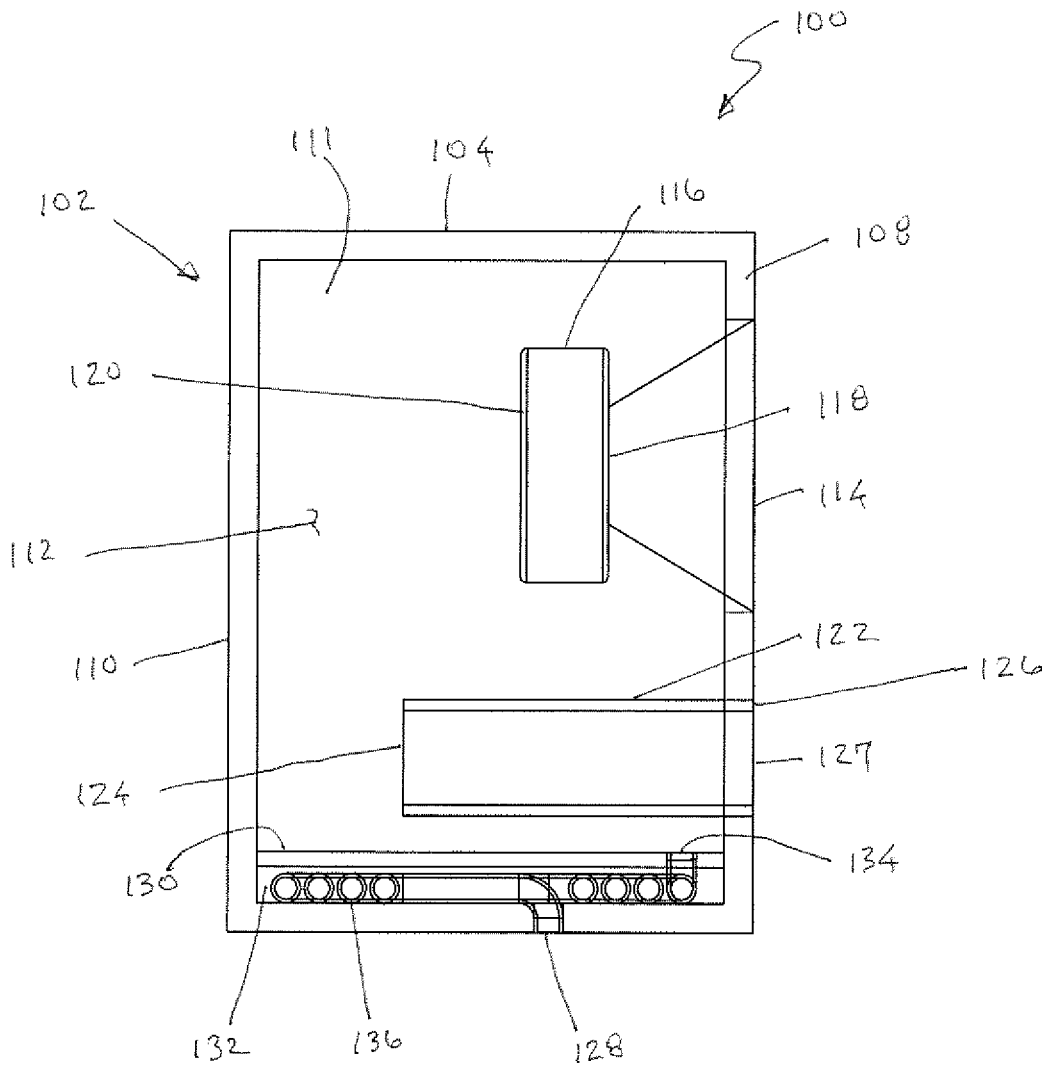
FIG. 16 is a view similar to FIG. 14 except with a shelf mounted in the box interior forming a compartment between it and the bottom wall of the ported box within which at least one drain tube is located.

FIGS. 1-13 illustrate embodiments of a loudspeaker system according to this invention in which a band-pass box is employed. Alternative embodiments of a loudspeaker system herein which are depicted in FIGS. 14-16 include a ported box. Each group of embodiments is described separately below.

Figure 1:
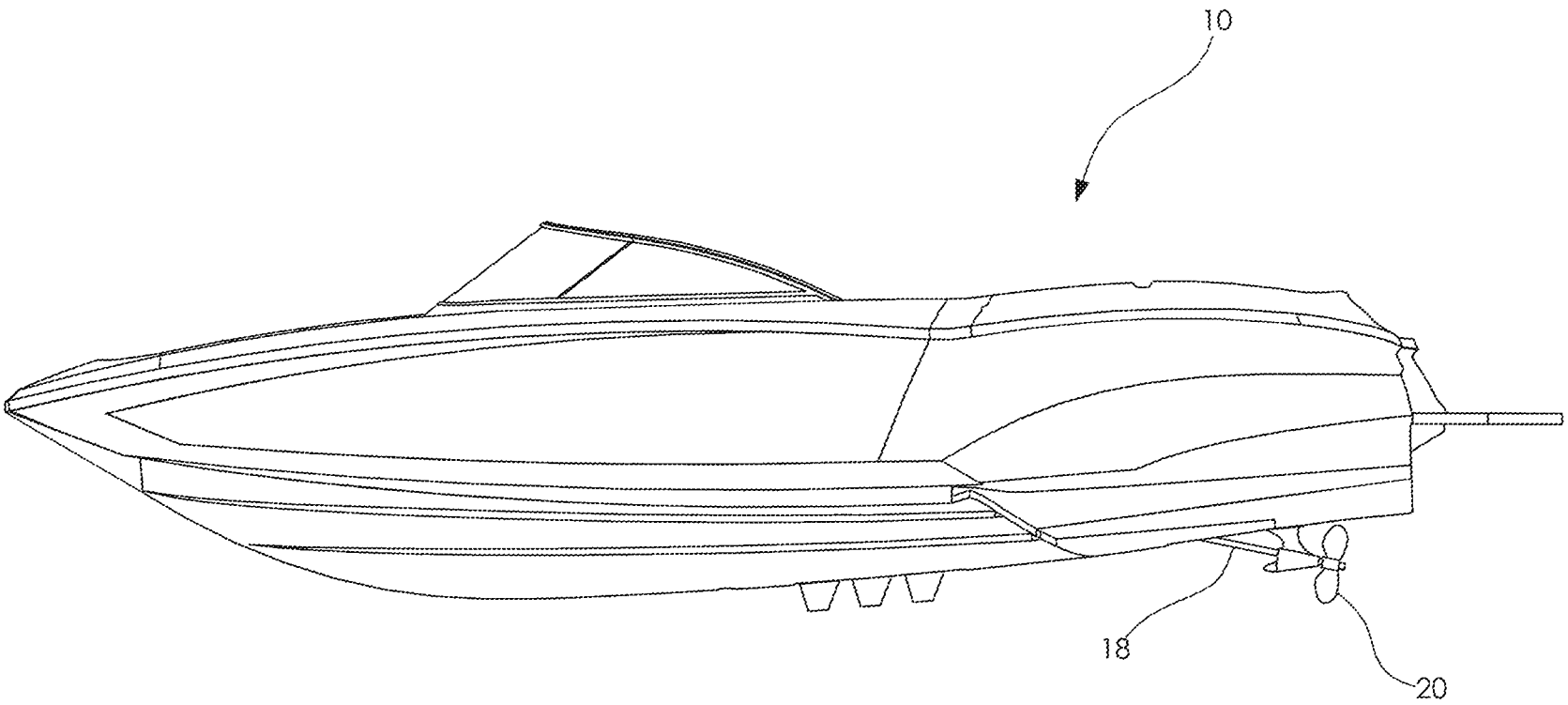
FIG. 1 is a perspective view of a watercraft provided with the loudspeaker system of one embodiment of this invention having a band-pass box.
Figure 2:
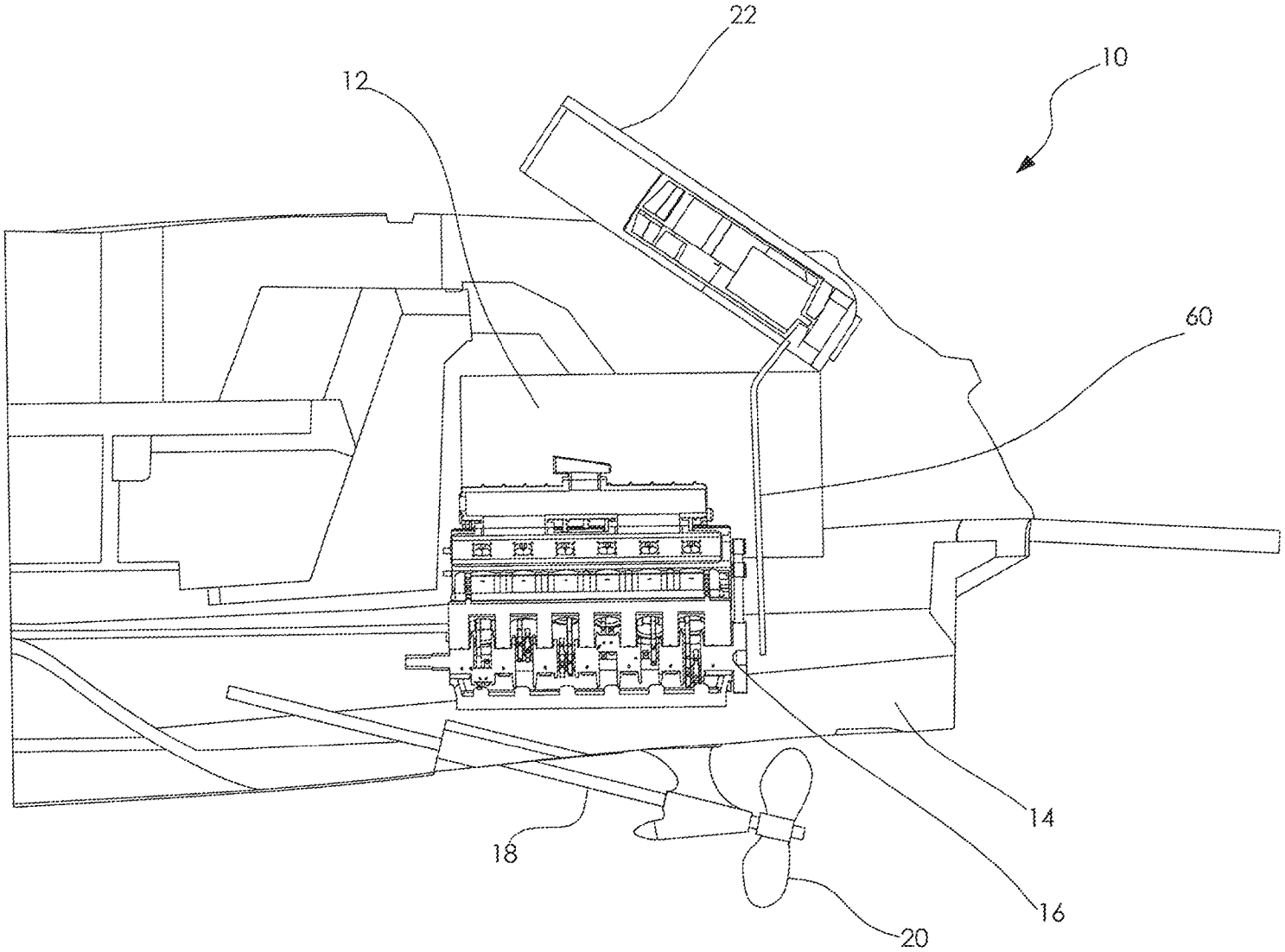
FIG. 2 is an enlarged view of the stern area of the boat depicted in FIG. 1, with part of the hull removed, illustrating the engine compartment and the loudspeaker system mounted to an engine cover panel which is shown in an open position.
Figure 3:
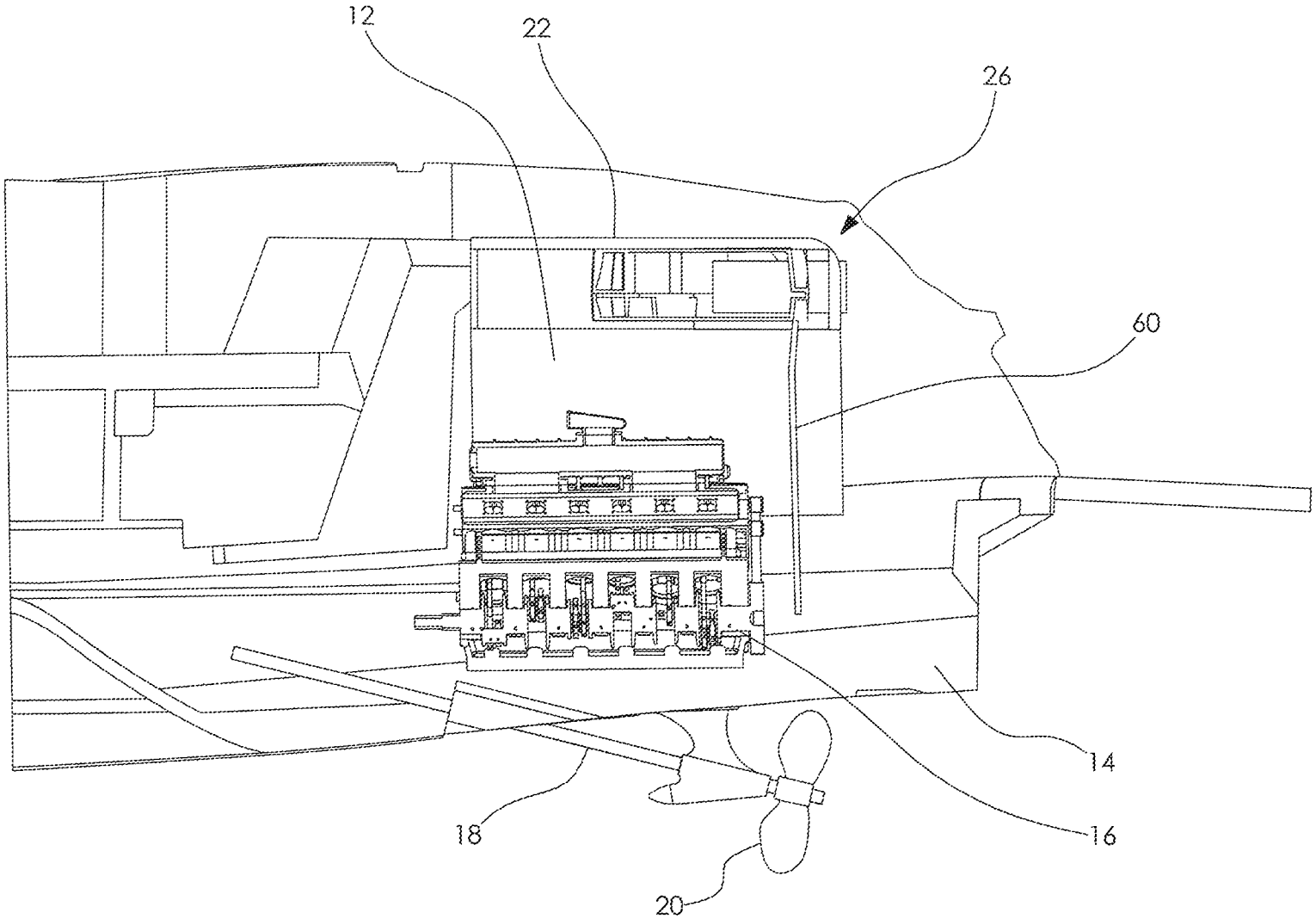
FIG. 3 is a view similar to FIG. 3 except with the engine cover panel in the closed position.
Figure 4:
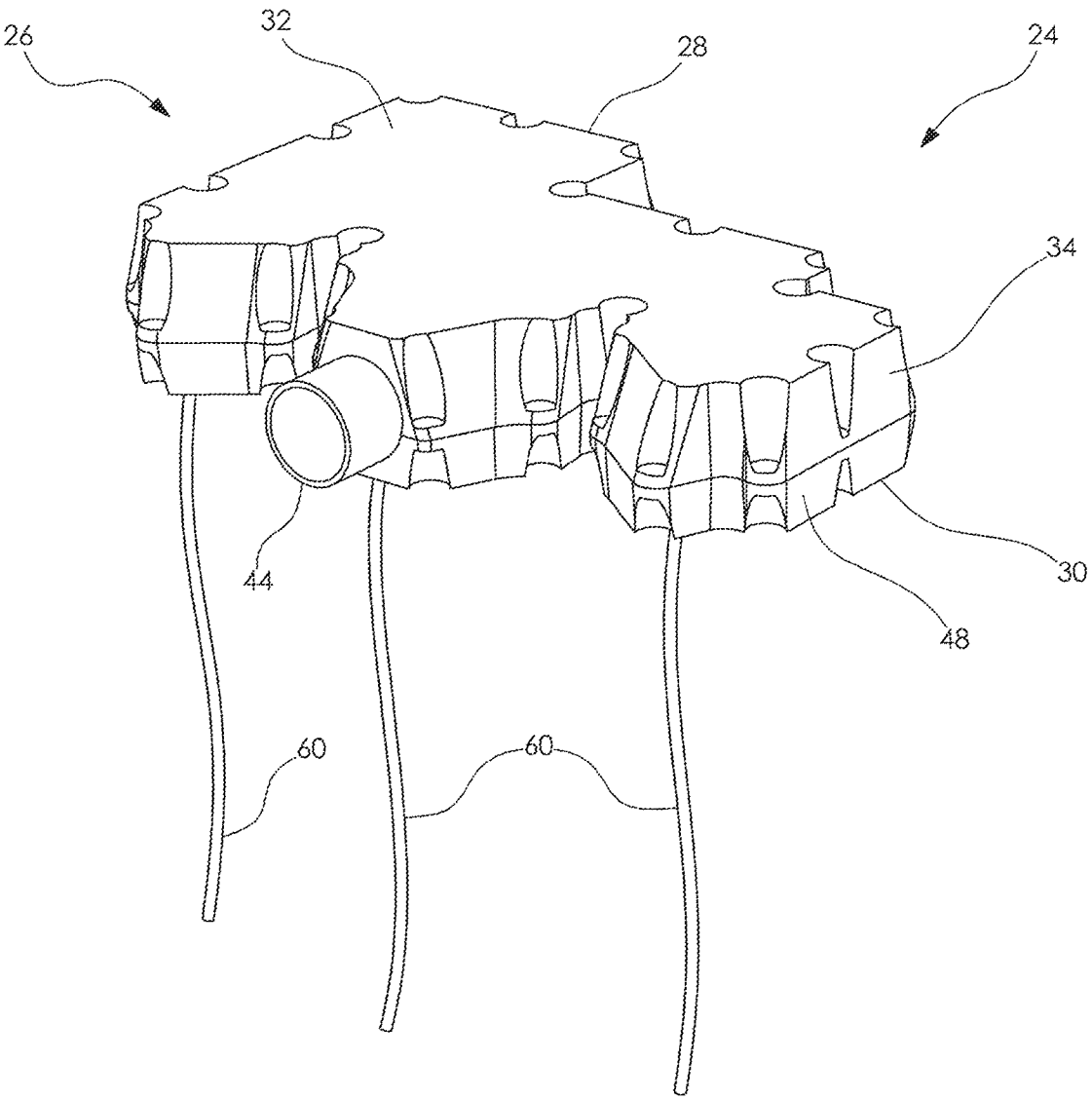
FIG. 4 is a perspective view of the assembled loudspeaker system of this invention.
Figure 5:
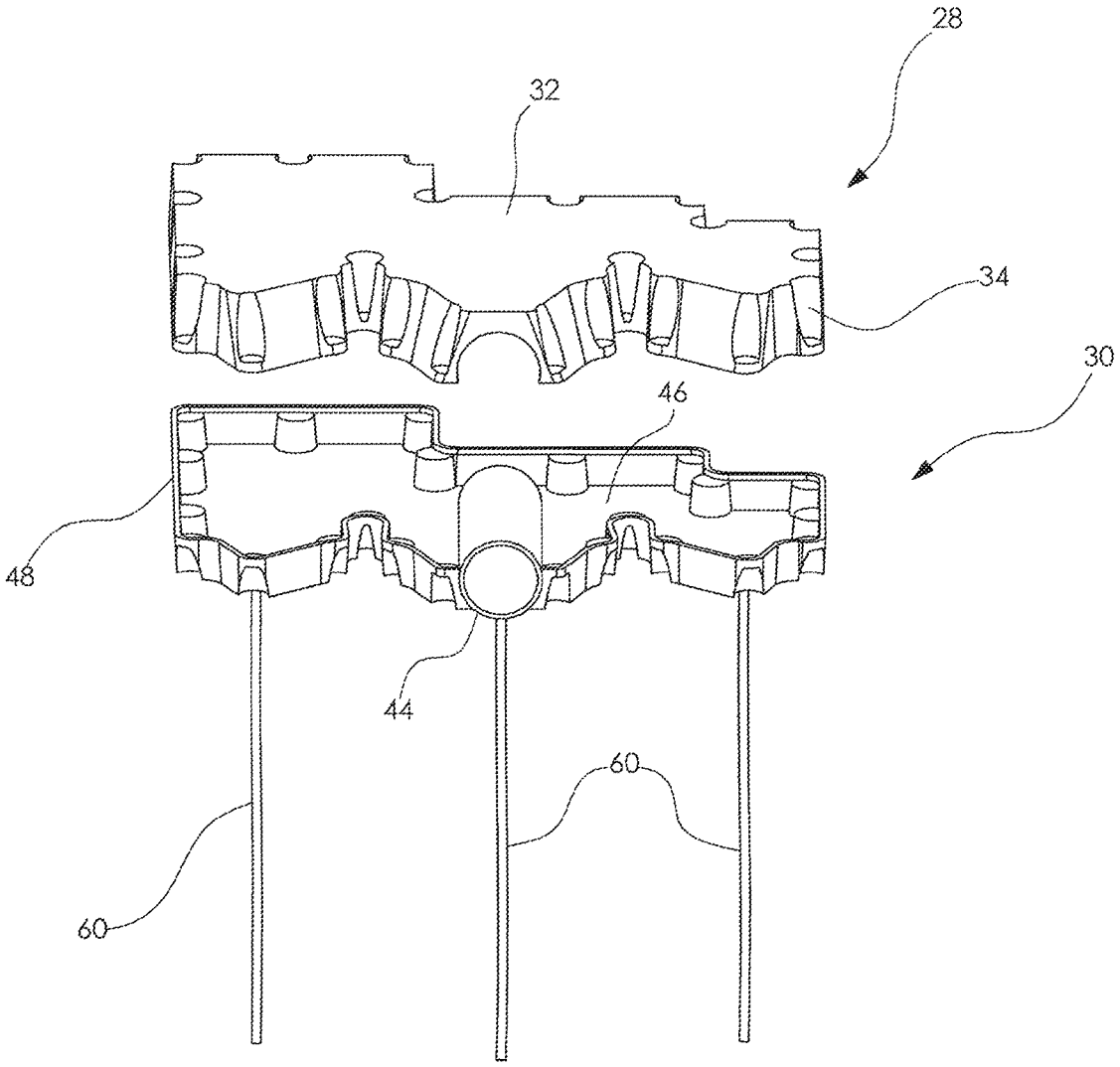
FIG. 5 is an exploded perspective view of the loudspeaker system depicted in FIG. 4, illustrating the two sections of the band-pass box of the system separated from one another.
Figure 6:
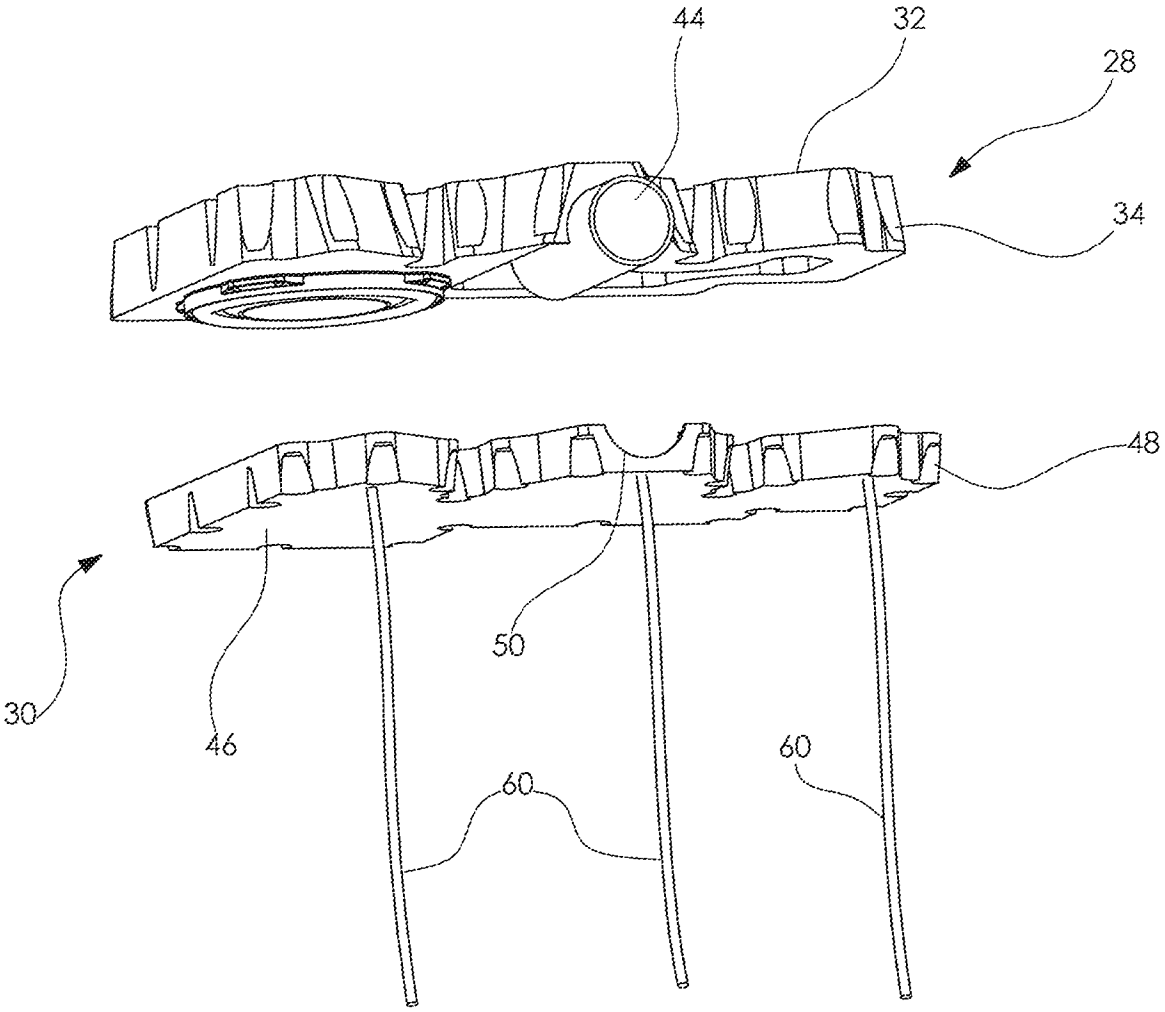
FIG. 6 is a perspective view similar to FIG. 5 except at a different angle and showing the position of the driver in the system.

Referring initially FIGS. 1-3, a watercraft 10 is schematically illustrated in FIGS. 1-3 having an engine compartment 12 with a bilge 14. An engine 16 is mounted in the compartment 12 which is coupled to a shaft 18 with a propeller 20 at one end. An engine cover panel 22 is hinged to the stern of the watercraft 10 and movable relative to the engine compartment 12 between an open position shown in FIG. 2 and a closed position depicted in FIG. 3.

Figure 7:
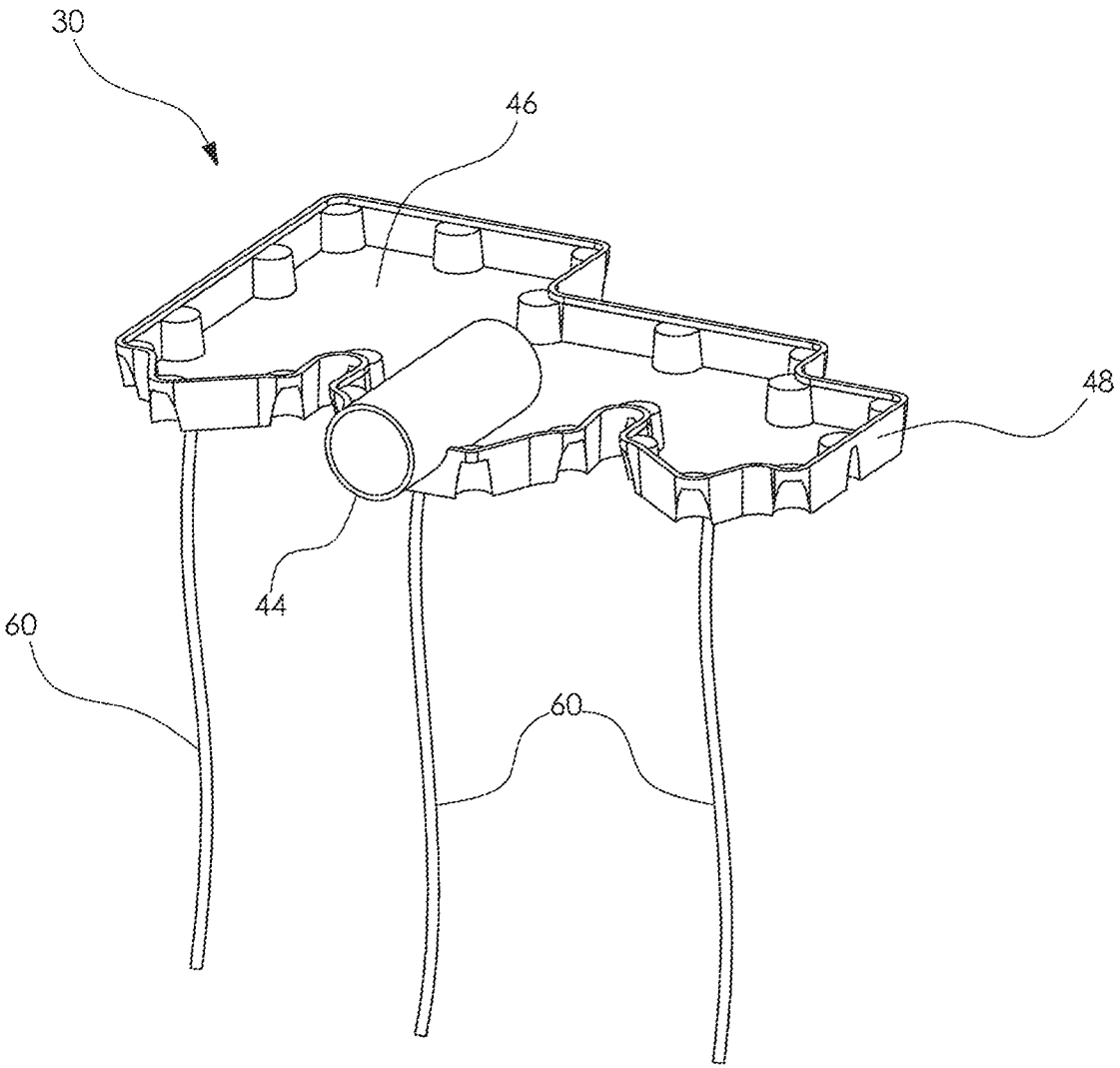
FIG. 7 is a perspective view of the lower section of the band-pass box of the loudspeaker system illustrated in FIG. 1.
Figure 8:
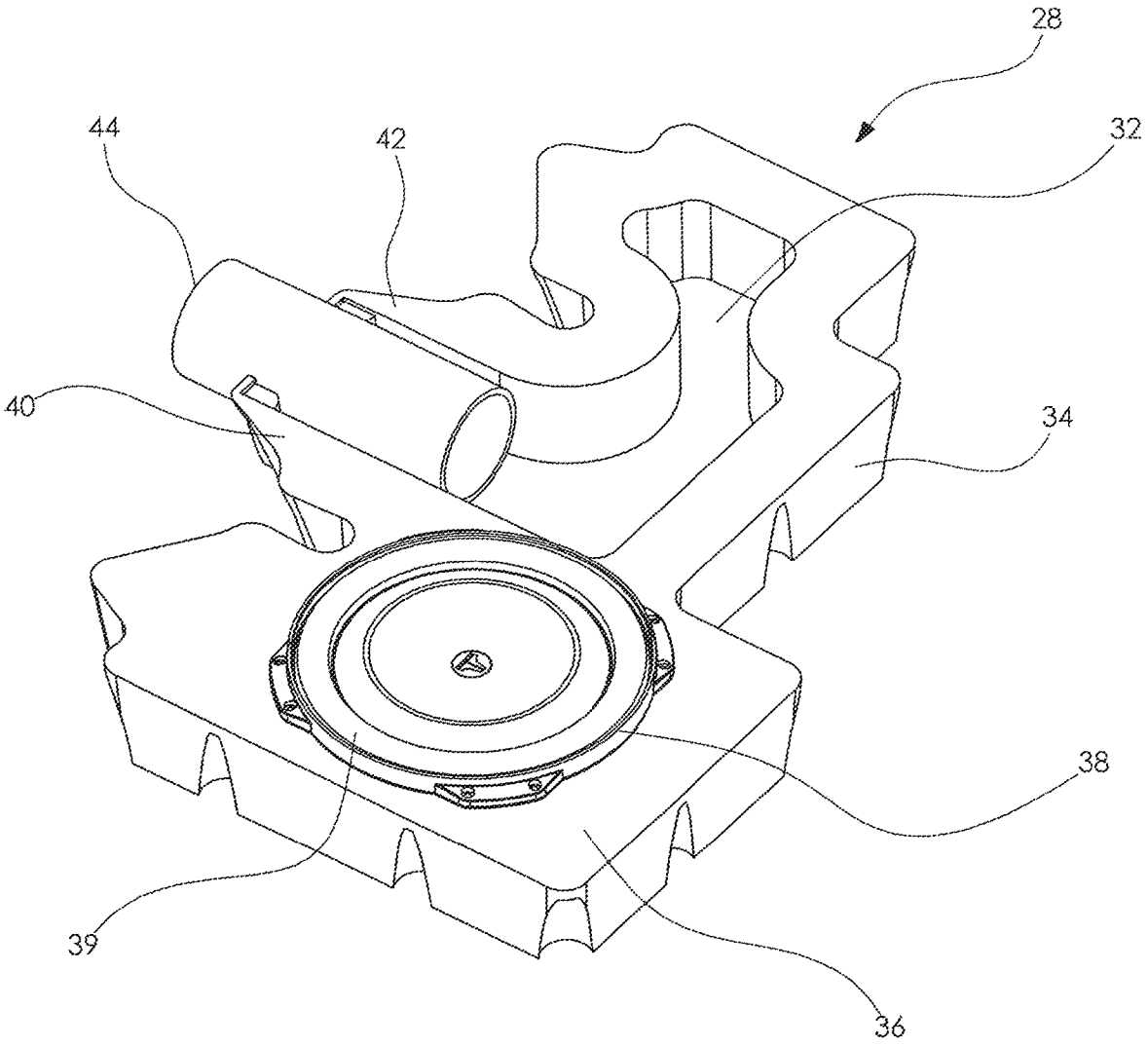
FIG. 8 is a perspective view of the upper section of the band-pass box showing the driver and a portion of the ported volume of the box.
Figure 9:
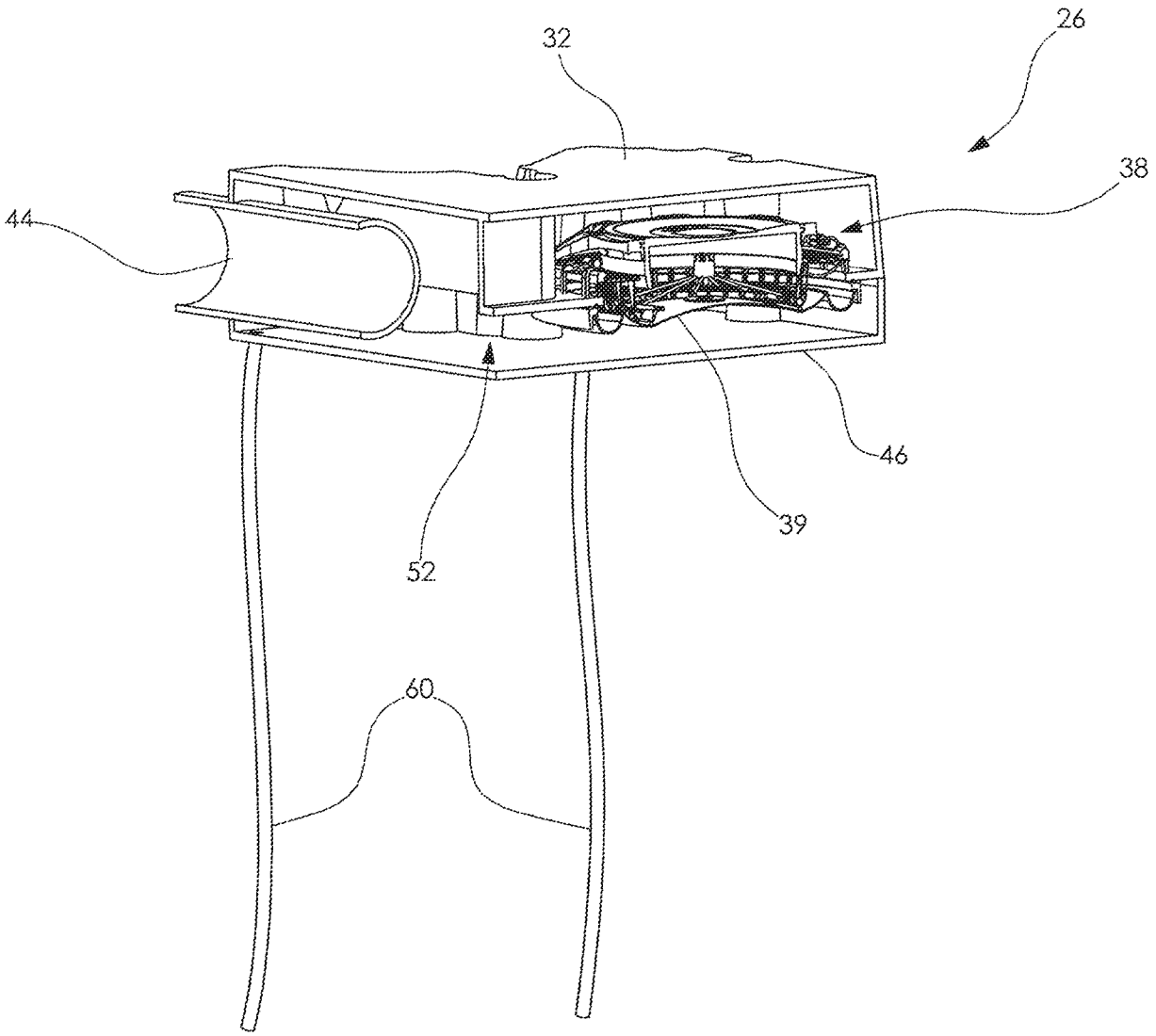
FIG. 9 is a cross sectional view of the assembled band-pass box with its back wall removed for ease of illustration.
Figure 10:
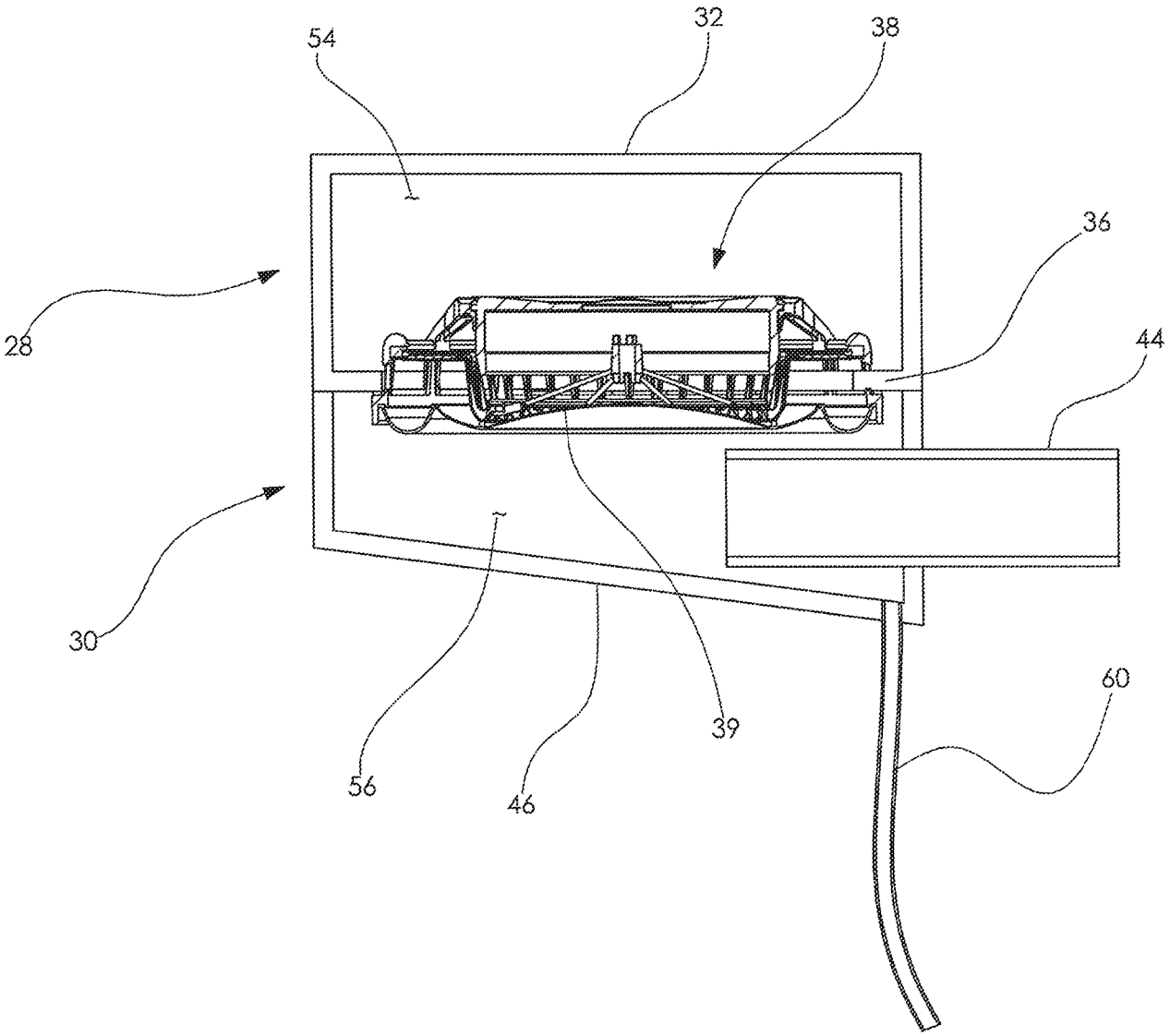
FIG. 10 is a schematic side view of another embodiment of this invention employing a band-pass box in which the bottom wall of the lower section of the band-pass box is illustrated at an angle relative to the top wall of the upper section, and the port is oriented substantially parallel to the top wall in a position spaced from the bottom wall.
Figure 11:
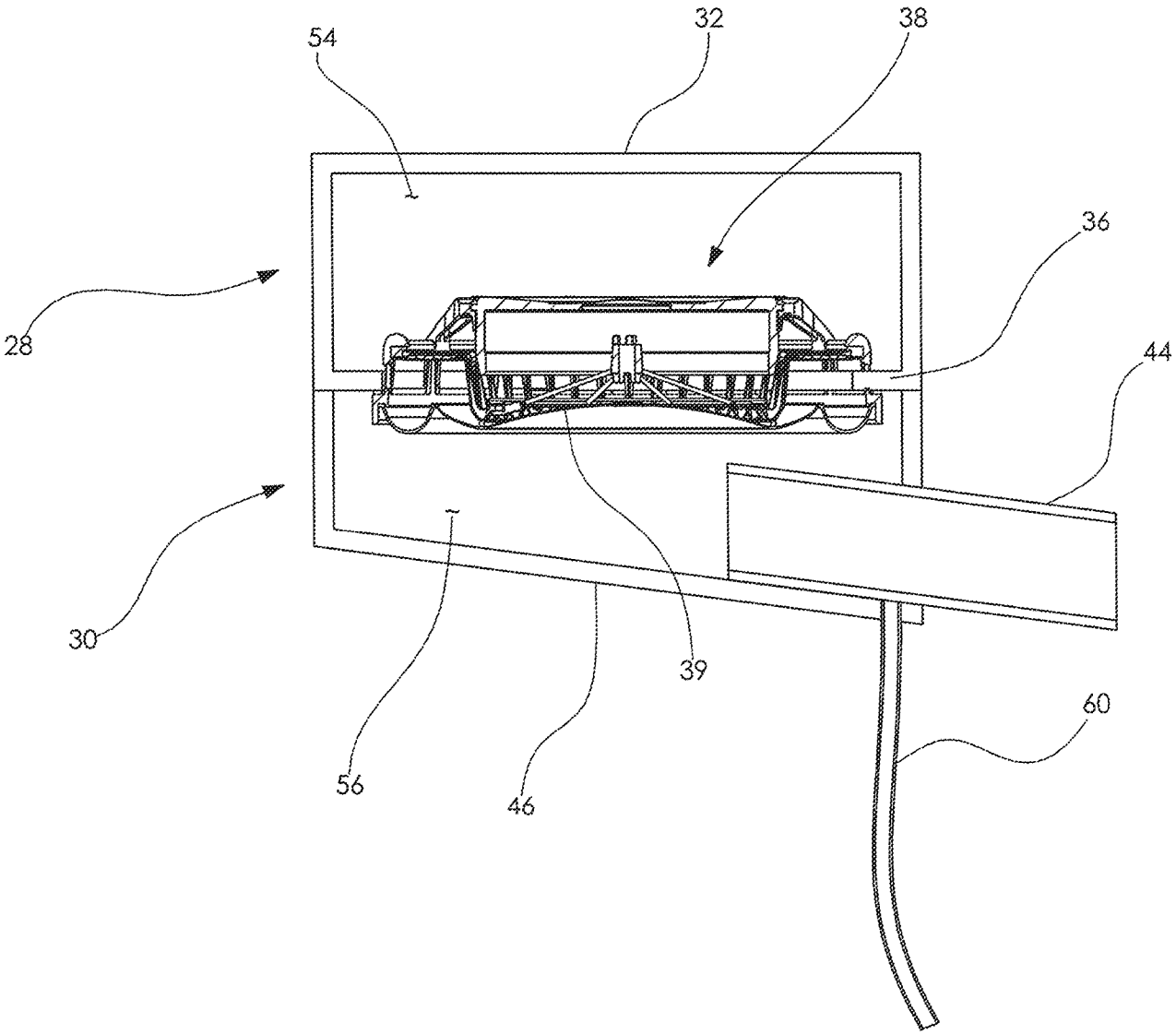
FIG. 11 is a view similar to FIG. 10 except with the port located along the bottom wall of the lower section.

With reference to FIGS. 4-9, one embodiment the loudspeaker system 24 of this invention may comprise a single-reflex band-pass box 26 having an upper section 28 and a lower section 30 which are permanently or releasably connected to one another. The upper section 28 has a top wall 32 connected to a side wall 34 which extends about the periphery of the box 26. As best seen in FIGS. 8, 10 and 11, a plate 36 is secured to a portion of the base of side wall 34 which mounts a driver 38. Additionally, the side wall 34 of upper section 28 has an opening 38, defined by opposed arms 40, 42, within which part of a port 44 is secured. Referring to FIG. 7, the lower section 30 comprises a bottom wall 46 connected to a side wall 48 which has the same peripheral shape as the side wall 34 of upper section 28 so that the upper and lower sections 28, 30 may be connected to one another to form the box 26 shown in FIG. 4. Preferably, a recess 50 is formed in the side wall 48 of the lower section 30 to engage and secure the lower portion of port 44 when the upper and lower sections 28, 20 are connected together. See FIGS. 6 and 7.

When the upper and lower sections 28, 30 are connected to one another, the band-pass box 26 depicted in FIGS. 4-9 has a box interior 52 with a sealed volume 54 and a ported volume 56. The sealed volume 54 comprises the space between the plate 36 which mounts driver 38, the top wall 32 of upper section 28 and that part of the side wall 34 which extends along the plate 36. As best seen in FIGS. 8-11, the "back" side of the driver 38, opposite its cone 39, is located within the sealed volume 54 of the box interior 52. The ported volume 56 of box 26 comprises the entire volume of the box interior 52 which is located on the opposite or "front" side of the driver 38. It is defined by the space between the top and bottom walls 32, 46, bounded by the side walls 34, 48 of respective upper and lower sections 28, 30 when connected together except for the sealed volume 54 described above. All of the acoustic output from the driver 38 is directed into the ported volume 56 of the box interior 52 and exits the band-pass box 26 through the port 44. Part of the port 44 is located within the ported volume 56 of the box interior 52, and part of it extends outwardly from the band-pass box 26.

Calculations of the ported volume, sealed volume, port diameter and port length for a band-pass box are well known in the art, and the details of same form no part of this invention. For purposes of illustration, assuming the driver 38 is a Model 12TW3 subwoofer commercially available from JL Audio, Inc. of Miramar, Fla., the sealed volume 54 may be 0.60 cubic feet, the ported volume 56 may be 0.80 cubic feet, and, the port 44 may be 4.0 inches in diameter and 11.625 inches in length. These values result in tuning the band-pass box 26 to a resonant frequency of about 54 Hz.

An important aspect of the embodiments of FIGS. 1-13 of this invention are features which allow the loudspeaker system 24 to be utilized in environments where water is present, such as in watercraft 10, while minimizing or eliminating damage to the driver 38. As shown in FIGS. 1-3, the band-pass box 26 of the loudspeaker system may be mounted to the engine cover panel 22 such that its port 44 faces rearwardly, i.e. in a direction toward a skier (not shown), for example, who may be towed by the watercraft 10. As illustrated in FIGS. 9-11, the plate 36 is located within the box interior 52 so that the driver 38 is positioned well above the bottom wall 46 of the lower section 30 of box 26 where water may enter through the port 44 and pool atop its bottom wall 46.

In order to prevent or at least reduce pooling of water within the box interior 52, a number of drain tubes 60 are connected to holes 62 formed in the bottom wall 46 of the lower section 30 of box 26. The drain tubes 60 extend from the box 26 to the bilge 14 of the watercraft 10 to remove water from the box interior 52. The use of drain tubes 60 is important to ensure proper acoustic performance of the loudspeaker system 14 of this invention. If only the holes 62 in the bottom wall 46 were provided, without drain tubes 60, there would be a significant acoustic leak, i.e. wide bandwidth noise caused by high-velocity air flow created by pressure shifts within the box interior 52 resulting from operation of the driver 38. Such acoustic leakage would lower the efficiency of the loudspeaker system 24 and create noise that could be bothersome to listeners.

The drain tubes 60 connected to the holes 62 are designed to only pass in-band signal airflow in a narrow frequency range well below the functional bandwidth of the loudspeaker system 24. In particular, the diameter and length of the drain tubes 60 are chosen so that they resonant at a specific low frequency. Due to the nature of acoustic resonance, there is only significant airflow through the drain tubes 60 in a small frequency range at which they are tuned and such tubes 60 are largely inert at other frequencies. In the particular example of the Model 12TW3 subwoofer, and assuming all of the parameters described above, a drain tube 60 having a 0.50 inch diameter and a length of about 60 inches is tuned to a resonant frequency of between 3 Hz and 5 Hz. Such frequencies are well below the tuned frequency of 54 Hz for the loudspeaker system 24.

In addition to reducing unwanted acoustic flow via resonance, the relatively long, about 60 inch drain tubes 60 having a 0.50 inch diameter create a relatively high resistance to airflow considering the surface area formed by their diameter and length. Air flowing into the drain tubes 60 engages their interior surfaces and inherently lowers the volume of air that can flow therethrough, thus highly damping the resonance of the tubes 60. This prevents "ringing" of the drain tubes 60 after excitation frequencies are removed. At the same time, however, the drain tubes 60 efficiently act as a static drain of water from the box interior 52.

Referring now to FIGS. 10 and 11, further embodiments of the loudspeaker system 24 employing a band-pass box 26 may be provided with additional features to assist in protecting the driver 38 from damage. As depicted in FIG. 10, the bottom wall 46 of the lower section 30 of box 26 may be disposed at an angle relative to the port 44, the plate 36 and the top wall 32 of upper section 28, all of which are illustrated in a generally horizontal orientation as viewed in FIG. 10. Drain tubes 60 are connected to the angled bottom wall 46, and function to drain water from the box interior 52, but drainage is enhanced by angling bottom wall 46 in a direction toward such drain tubes 60. In FIG. 10, the port 44 is mounted to the box 26 in position spaced above the bottom wall 46 such that little drainage of water, if any, occurs through the port 44.

The embodiment of FIG. 11 has the same construction as FIG. 10 except that the port 44 is mounted along the angled bottom wall 46. While drain tubes 60 may be employed in this embodiment, it is contemplated that a significant proportion of water entering the box interior 52 would be drained through the port 44 instead of the drain tubes 60.

Figure 12:
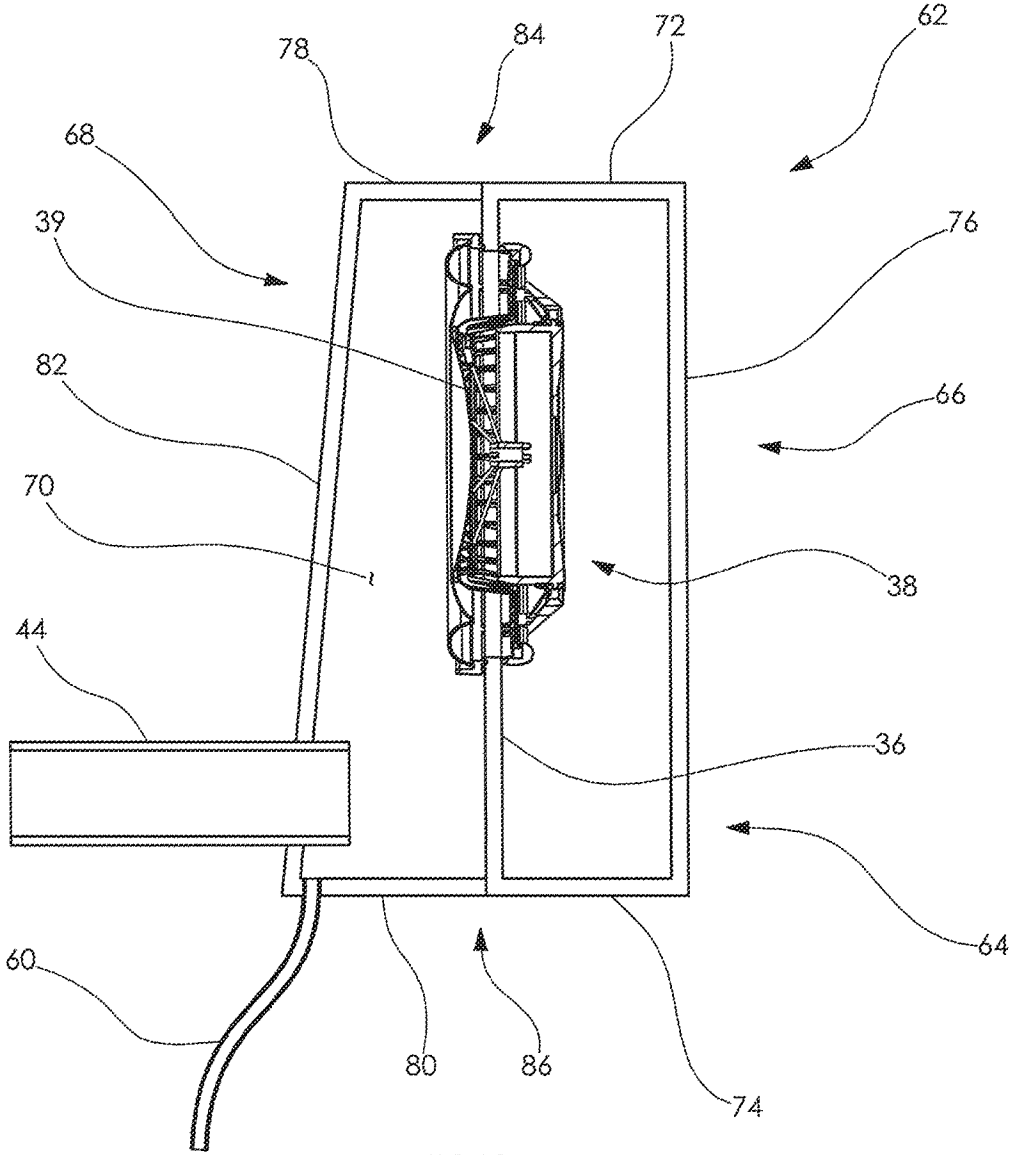
FIG. 12 is a schematic side view of a further embodiment of this invention in which the band-pass box is constructed in a substantially vertical orientation compared to the embodiments of FIGS. 1-11.
Figure 13:
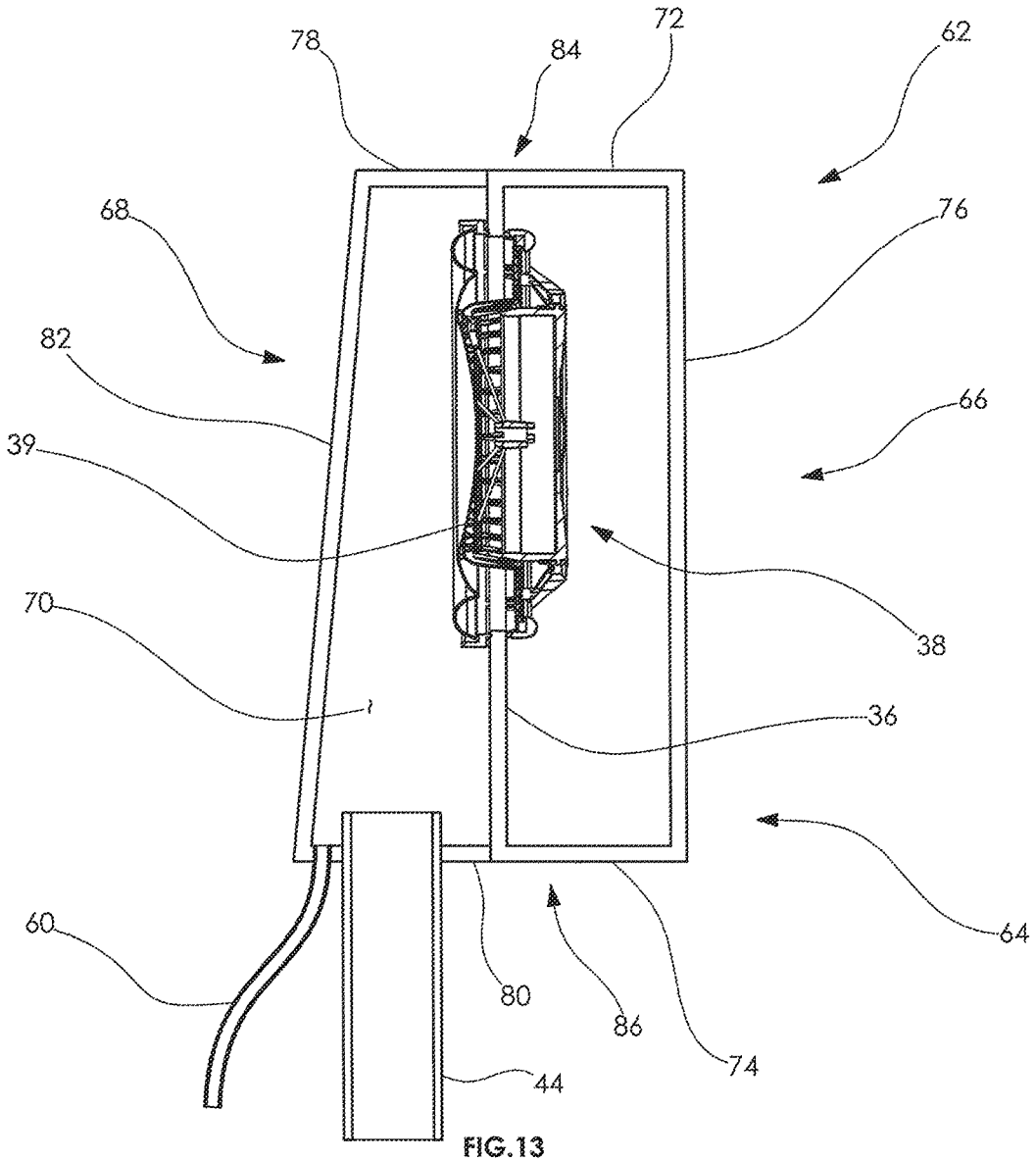
FIG. 13 is a view similar to FIG. 3 except with the port located in a different position.

Other alternative embodiments of the loudspeaker system 24 of this invention, employing a band-pass box 26, are shown in FIGS. 12 and 13. The loudspeaker system 24 illustrated in FIGS. 1-11 depict the band-pass box 26 in a generally horizontal orientation such that the top wall 32, bottom wall 46, plate 36 and driver 38 are all substantially horizontal except for the angled bottom wall 46 in FIGS. 10 and 11. It is contemplated that in some watercraft 10, due to space considerations or other design features, it may be preferable to employ a loudspeaker system 62 which is substantially vertically oriented as shown in FIGS. 12 and 13. For purposes of the present discussion, structure which is the same as in FIGS. 1-11 are denoted by the same reference numbers in FIGS. 12 and 13.

The band-pass box 64 of FIGS. 12 and 13 includes a first section 66 connected to a second section 68 defining a box interior 70. The first section 66 comprises a first end wall 72, a second end wall 74 and a first side wall 76 extending between the end walls 72, 74. The second section 68 comprises a third end wall 78, a fourth end wall 80 and a second side wall 82 extending between the end walls 78, 80. When the first and second sections 66, 68 are connected together, the first and third end walls 72, 78 collectively form a top wall 84 of the band-pass box 64, and the second and fourth end walls 74, 80 collectively form a bottom wall 86 thereof. The first section 66 includes plate 36 which mounts driver 38 as in the embodiments described above.

In the embodiment of FIG. 12, the port 44 is mounted to and extends outwardly from the second side wall 82 of the second section 68 of band-pass box 64. A number of drain tubes 60 are mounted over holes (not shown) in the fourth end wall 80 portion of bottom wall 84 to drain water entering the box interior 70 through port 44. It should be noted that the driver 38 is located along the plate 36 proximate the top wall 84 and spaced from the bottom wall 86 so as to avoid exposure to water which may pool within the box interior 70 before being discharged from the drain tubes 60 and/or port 44. The embodiment of FIG. 13 is the same as that of FIG. 12, except the port 44 is mounted to the fourth end wall 80 portion of bottom wall 86 rather than second side wall 82. Operation of the loudspeaker system 62 of FIGS. 12 and 13 is the same as that described above in connection with a discussion of FIGS. 1-11.

Referring now to FIGS. 14-16, alternative embodiments of a loudspeaker system 100 according to this invention are shown. As noted above, the system 100 employs a ported box 102 which is described below.

Preferably, the ported box 102 comprises a top wall 104, a bottom wall 106, a front wall 108, a back wall 110 and opposed side walls 111 only one of which is shown in the drawings. The walls 104-111 collectively form a box interior 112. The front wall 108 is formed with an aperture 114 and mounts a driver 116 within the box interior 112. The driver 116 has a front side 118 facing the aperture 114 and a back side 120 facing the back wall 110. A port 122 is also mounted to the front wall 108 within the box interior 112 with an input end 124 facing the back wall 110 and an output end 126 facing a second aperture 127 formed in the front wall 108. Acoustic output from the front side 118 of driver 116 is directed toward the front wall 108 and out of the box interior 112 through aperture 114. Acoustic output from the back side 120 of driver 116 is directed to the input end 124 of the port 122, travels through the port 122 toward the front wall 108, and then exits the output end 126 of port 122 out the aperture 127 in front wall 108.

In the embodiments of system 100 illustrated in FIGS. 14 and 15, the bottom wall 106 of ported box 102 is formed with a bottom opening 128. The system 100 shown in FIG. 15 differs from that in FIG. 14 in that its bottom wall 106 is angled in a direction from back to front toward the bottom opening 128.

The embodiment of system 100 depicted in FIG. 16 is similar to that of FIG. 14 except a shelf 130 is mounted within the box interior 112 forming a compartment 132 between the shelf 130 and bottom wall 106. The shelf 130 is formed with a shelf opening 134, and bottom wall 106 has the same bottom opening 128 as in FIGS. 14 and 15.

The box interior 112 of each of the embodiments of FIGS. 14 and 15 defines a ported volume, i.e. the volume between the top and bottom walls 104, 106, the front and back walls 108, 110 and the opposed end walls 111. The ported volume of the box interior 112 of the embodiment of FIG. 16 is essentially the same as that of FIGS. 14 and 15, reduced only by the volume of compartment 132.

Calculations of the ported volume, port diameter and port length for a ported box or enclosure are well known in the art, and the details of same form no part of this invention. For purposes of illustration, the driver 116 may be the same as driver 38 noted above in connection with a discussion of FIGS. 1-13, i.e. a Model 12TW3 subwoofer commercially available from JL Audio, Inc. of Miramar, Fla. With that driver 116, the ported volume of each of the embodiments of FIGS. 14-16 may be 1.0 cubic feet, the diameter of port 122 may be 4.0 inches, and, the length of the port 122 may be 30.0 inches. These values result in tuning the ported box 102 to a resonant frequency of about 32 Hz.

As in the embodiments of FIGS. 1-13, an important aspect of the embodiments of FIGS. 14-16 of this invention is to allow the loudspeaker system 100 to be utilized in environments where water is present, such as various outdoor applications, while minimizing or eliminating damage to the driver 116. In order to prevent or at least reduce pooling of water within the box interior 112, at least one drain tube 136 is provided in system 100. As seen in FIGS. 14 and 15, one end of drain tube 136 may be connected to the bottom opening 128 in bottom wall 106 and the drain tube 136 may extend outwardly from the ported box 102 such that an opposite end thereof is spaced from the bottom wall 106. In the embodiment of FIG. 16, the drain tube 136 is located entirely with the compartment 132, preferably arranged in a spiral orientation. One end of drain tube 136 in FIG. 16 is connected to the shelf opening 134, in communication with the box interior 112, and its opposite end is connected to the bottom opening 128. In each of the embodiments of FIGS. 14-16, the drain tube 136 is effective to drain water that may pool in the bpx interior 112 having entered through the port 122. It should be understood that more than one drain tube 136 may be employed in each of the embodiments of FIGS. 14-16, if desired.

The use of drain tube(s) 136 is important to ensure proper acoustic performance of the loudspeaker system 100. If only the bottom opening 128 in bottom wall 106 was provided, without drain tube(s) 136, there would be a significant acoustic leak, i.e. wide bandwidth noise caused by high-velocity air flow created by pressure shifts within the box interior 112 resulting from operation of the driver 116. Such acoustic leakage would lower the efficiency of the loudspeaker system 100 and create noise that could be bothersome to listeners.

The drain tube(s) 136 connected to the bottom opening 128 in FIGS. 14 and 15, and to the shelf opening 134 and bottom opening 128 in FIG. 16, are designed to pass only in-band signal airflow in a narrow frequency range well below the functional bandwidth of the loudspeaker system 100. In particular, the diameter and length of the drain tube(s) 136 are chosen so that they resonant at a specific low frequency. Due to the nature of acoustic resonance, there is significant airflow through the drain tube(s) 136 only in a small frequency range at which they are tuned and such tube(s) 136 are largely inert at other frequencies. In the particular example of the Model 12TW3 subwoofer, and assuming all of the parameters of the ported box 102 described above, a drain tube 136 having a 0.50 inch diameter and a length of about 21 inches is tuned to a resonant frequency of about 5 Hz. If a drain tube 136 having a diameter of 0.25 inches is employed, it has a length of about 5.1 inches. The tuned frequency of 5 Hz. Of drain tube(s) is therefore well below the tuned frequency of about 32 Hz for the loudspeaker system 100.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof.

The specific example of the loudspeaker systems 24, 62 and 100 of this invention designed for use with a Model 12TW3 subwoofer are intended for illustration purposes only. Different sizes of subwoofers would require different parameters, including ported volume, port diameter, port length, drain tube diameter and drain tube length. The discussion given above is therefore not intended to be limited but merely indicative of the relationship between such parameters and the relative resonant frequencies of the ported volume of the band-pass box 26 and the drain tubes 60 and of the ported box 102 and drain tube(s) 136.

Additionally, the loudspeaker systems 24 and 62 are depicted as being mounted to the engine cover panel 22 of a watercraft 10 having an engine compartment 12 with a bilge 14. It is contemplated that the systems 24 or 62 could be mounted elsewhere on boats of this type, and/or be utilized with watercraft without an engine compartment such as those having outboard motors.

Therefore, it is intended that the invention not be limited to the particular embodiment disclosed as the best mode contemplated for carrying out this invention, but that the invention will include all embodiments falling within the scope of the appended claims.

What is claimed is:

1. A loudspeaker system, comprising:

A ported box comprising a top wall, a bottom wall, a front wall, a back wall and opposed side walls interconnected to collectively form a box interior which defines a ported volume, said bottom wall being formed with a bottom wall opening;

a port located within said enclosure interior, said port having a port diameter and a port length, said ported volume, said port diameter and said port length collectively being tuned to a first resonant frequency;

a driver mounted within said enclosure interior in a position to direct acoustic output from a front side thereof toward said front wall and to direct acoustic output from a back side thereof through said port and toward said front wall;

at least one drain tube connected to said bottom wall opening in communication with said box interior, said at least one drain tube having a tube diameter and a tube length collectively tuned to a second resonant frequency which is less than said first resonant frequency, said at least one drain tube being effective to drain water which enters said box interior through said port.

2. The loudspeaker system of claim 1 in which said at least one drain tube has a first end connected to said bottom wall opening and a second end extending outwardly from said ported box and spaced from said bottom wall.

3. The loudspeaker system of claim 2 in which said bottom wall is oriented at an angle relative to said top wall so that water entering said box interior flows in a direction toward said at least one drain tube.

4. The loudspeaker system of claim 1 further including a shelf located within said box interior, a compartment being formed between said shelf and said bottom wall, said shelf being formed with a shelf opening communicating with said ported volume.

5. The loudspeaker system of claim 4 in which said at least one drain tube is located within said compartment, said at least one drain tube having a first end connected to said shelf opening and a second end connected to said bottom wall opening.

6. The loudspeaker system of claim 5 in which said at least one drain tube is arranged in a spiral within said compartment.

* * * * *